US006378323B1

(12) United States Patent
Chavagnat

(10) Patent No.: US 6,378,323 B1
(45) Date of Patent: Apr. 30, 2002

(54) REVERSIBLE HEAT PUMP WITH SUB-COOLING RECEIVER

(75) Inventor: Hippolyte Chavagnat, Montluel (FR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/642,050

(22) Filed: Aug. 18, 2000

(30) Foreign Application Priority Data

Sep. 22, 1999 (EP) ..... 99307484

(51) Int. Cl.[7] ..... F25B 27/00; F25B 41/00
(52) U.S. Cl. ..... 62/324.4; 62/324.1; 62/513
(58) Field of Search ..... 62/324.1, 324.4, 62/324.3, 324.6, 174, 503, 509, 513; 165/201, 240, 241; 237/2 B

(56) References Cited

U.S. PATENT DOCUMENTS 3,938,349 A 2/1976 Ueno ..... 62/197
4,030,315 A * 6/1977 Harnish ..... 62/503
4,236,381 A * 12/1980 Imral et al. ..... 62/324.4
5,491,981 A 2/1996 Kim ..... 62/324.6
5,619,865 A * 4/1997 Maxwell ..... 62/503 X
5,784,892 A * 7/1998 Reedy ..... 62/174

* cited by examiner

*Primary Examiner*—Denise L. Esquivel
*Assistant Examiner*—Chen-Wen Jiang

(57) ABSTRACT

A reversible heat pump system includes heat exchangers having significantly different refrigerant handling capacities and a refrigerant holding device for holding excess refrigerant during the heating mode of operation. The refrigerant holding device includes a heat exchanger located therein for subcooling the refrigerant in the refrigerant holding device during the heating mode. The heat exchanger in the refrigerant holding device circulates suction pressure refrigerant through the refrigerant holding device before the suction pressure refrigerant enters the suction inlet of the compressor.

13 Claims, 2 Drawing Sheets

REVERSIBLE HEAT PUMP WITH SUB-COOLING RECEIVER

FIELD OF THE INVENTION

The present invention relates to improvements in reversible heat pumps that operate in heating and cooling modes. The invention is particularly directed to heat pumps wherein there is a significant disparity in the refrigerant handling capacities of the heat exchangers in such heat pumps.

BACKGROUND OF THE INVENTION

Reversible heat pump systems typically include a refrigerant loop with at least two heat exchangers. It is desirable to sometimes select different types of heat exchangers having considerably different capacities for handling the refrigerant in this loop. For example one might wish to use a brazed plate heat exchanger in combination with a more traditional coil heat exchanger in a reversible heat pump system.

The brazed plate heat exchanger typically comprises a series of brazed plates having channels formed therein for carrying the refrigerant. The brazed plates also have channels formed therein for carrying a heat exchange medium which is either heated or cooled by the refrigerant depending on whether the refrigerant is absorbing or giving up heat. These channels do not however provide the same refrigerant handling capacity as a typical coil heat exchanger that may be the preferred second heat exchanger in the reversible heat pump.

The channels of the brazed plate heat exchanger also cannot tolerate a significant build up of condensed refrigerant if this heat exchanger is to operate as a condenser during the heating mode when relatively hot refrigerant flowing through the channels of the heat exchanger is condensing and giving up heat. In this regard, any significant build up of condensed refrigerant in the heat exchanger will result in an increase in discharge pressure.

The above need to assure that the refrigerant is not appreciably condensed to liquid form in the smaller capacity brazed plate heat exchanger will however pose a separate problem for the downstream thermal expansion valve. In this regard, the downstream thermal expansion valve works best when the refrigerant is fed to this valve in liquid form free from bubbles.

OBJECTS OF THE INVENTION

It is an object of the invention to provide a heat pump system with a refrigerant loop that relieves a low capacity heat exchanger of any significant build up of condensed liquid refrigerant when operating as a condenser during the heating mode.

It is another object of the invention to provide a heat pump system with a refrigerant loop that assures that the refrigerant is appropriately subcooled before being applied to the thermal expansion valve.

SUMMARY OF THE INVENTION

The above and other objects are achieved by providing a receiver that receives refrigerant from a low refrigerant handling capacity heat exchanger when operating as a condenser in a reversible heat pump system during the heating mode. The receiver includes a subcooling device. The subcooling device takes refrigerant emitted from the suction outlet of the second heat exchanger operating as an evaporator and circulates the low pressure refrigerant back through the receiver containing the high pressure refrigerant from the low capacity heat exchanger operating as a condenser. The high-pressure refrigerant in the receiver is subcooled to a point where the liquid refrigerant can be provided to the thermal expansion valve without concern for the refrigerant being in other than complete liquid form.

The receiver containing the refrigerant is sized so as to accommodate the volume of excess refrigerant that will likely be present in the reversible heat pump during the heating mode. The size of the receiver is preferably somewhat larger than this volume of excess refrigerant.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
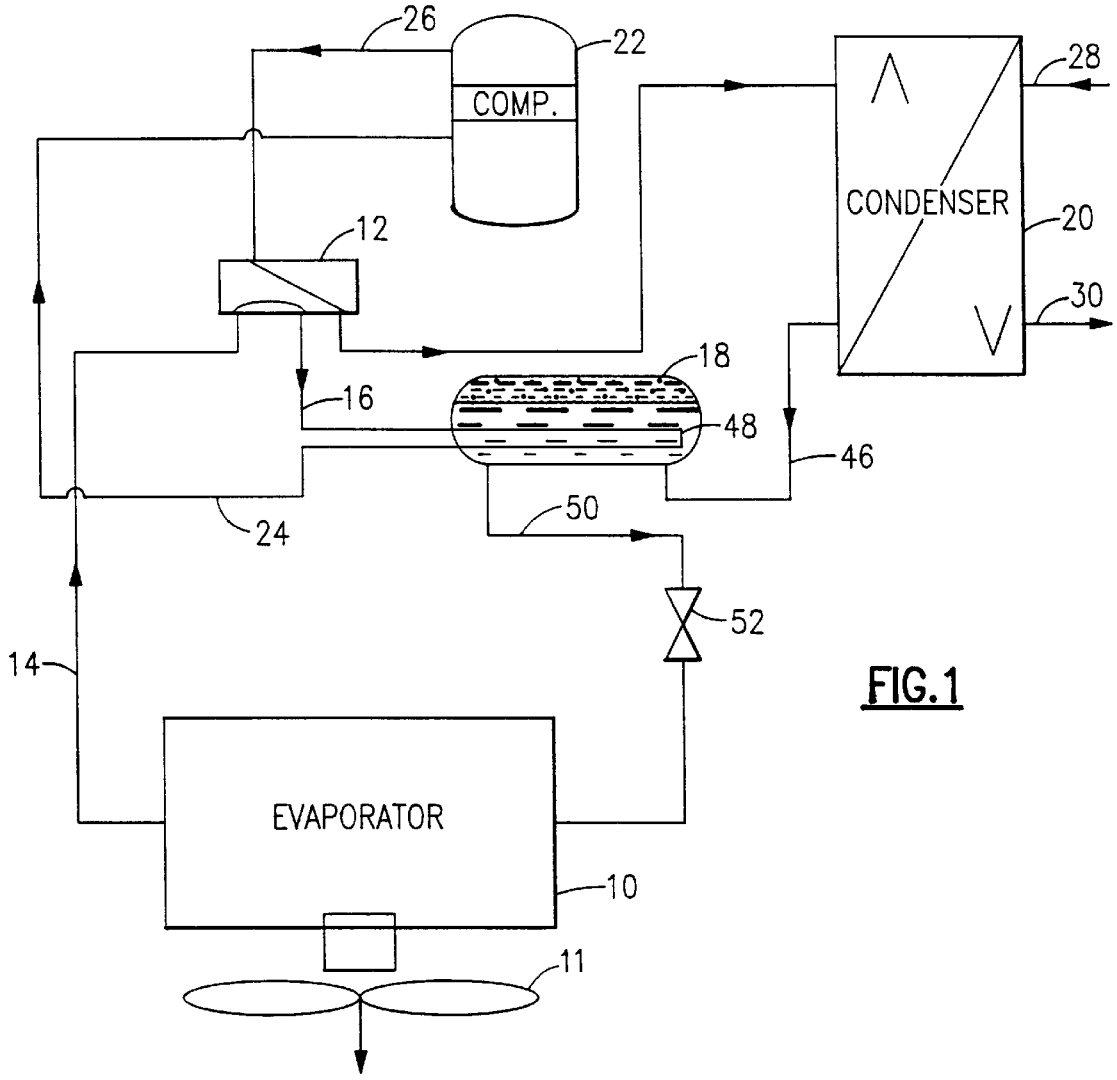
FIG. 1 illustrates a reversible heat pump system operating in a heating mode.

Referring to FIG. 1, a reversible heat pump system is illustrated in schematic form as it would operate in a heating mode. During the heating mode, heat is withdrawn from air being drawn over a heat exchanger 10 by a fan 11. The heat exchanger 10 is preferably a coil type of heat exchanger functioning as an evaporator in the heating mode. It is to be appreciated that the heat exchanger 10 could also be another type of heat exchanger appropriately sized so as to remove heat from the air or some other medium in heat exchange relationship with the refrigerant passing through the heat exchanger. In any event, the refrigerant absorbs a large quantity of heat from whatever the heat exchange medium is and stores it in vapor form for later release.

The discharged refrigerant vapor from the evaporator heat exchanger 10 flows through a reversing valve 12 via a line 14 where it is directed over a line 16 to a receiver 18 containing high pressure refrigerant from a heat exchanger 20 operating as a condenser in the heating mode. The circulated vapor is drawn into a compressor 22 at a low pressure from a suction line 24. The compressor 22 discharges the vapor at a high pressure to the four-way reversing valve 12 via a line 26. The reversing valve directs the high pressure refrigerant vapor to heat exchanger 20, which functions as a condenser in the heating mode. The heat of condensation of the condensing refrigerant is preferably absorbed by water circulating through the heat exchanger 20. The water enters the heat exchanger 20 via cold water line 28 and leaves via hot water line 30.

Figure 2A:
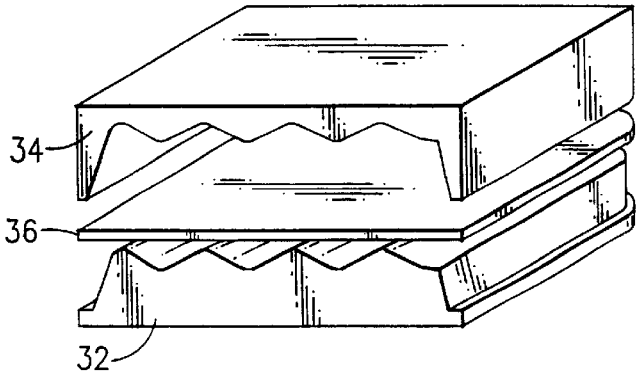
FIGS. 2A and 2B illustrate a brazed plate heat exchanger preferably used in the heat pump system in FIG. 1.
Figure 2B:
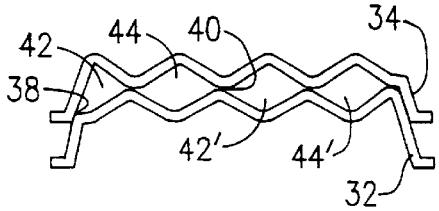

The heat exchanger 20 is preferably a brazed plate heat exchanger. This type of heat exchanger is formed by pressing together grooved plates such as 32 and 34 with a copper foil 36 there between as shown in FIG. 2A. The plates are then typically placed in a vacuum oven and heated to the melting point of the copper. The copper collects at the edges 38 and the contact points 40 of the grooved plates 32 and 34 so as to form sealed off channels such as 42 and 44, as shown in FIG. 2B. A stack of such plates allows the refrigerant to, for instance, flow through alternate channels 42 and 42' whereas a heat exchange medium such as water flows through channels 44 and 44'. The water flowing through channels 44 and 44' absorbs the heat of condensation of the refrigerant flowing through channels 42 and 42' when the brazed plates are operating together as a condenser.

Referring again to FIG. 1, the refrigerant exits the heat exchanger 20 as a mixture of vapor and liquid refrigerant at high pressure and flows into a receiver 18 via a line 46. The pool of high pressure refrigerant in the receiver is subcooled by low pressure vaporized refrigerant from the outlet of the heat exchanger 10. This low pressure vaporized refrigerant is provided to the receiver 18 via line 14, reversing valve 12, and line 16. Piping 48, connected to lines 16 and 24, allows the refrigerant to circulate in heat exchange relationship with a pool of high pressure refrigerant in the receiver. The pool of high pressure, hot refrigerant liquid in the receiver 18 is preferably subcooled by the circulating vaporized refrigerant to a point where any bubbling in the hot refrigerant is eliminated. The subcooled liquid refrigerant passes out of the receiver on a line 50 connected to a thermal expansion valve 52. The thermal expansion valve 52 allows the liquid refrigerant to expand to a lower pressure before entering the heat exchanger 10. Refrigerant vapor resulting from evaporation of the liquid refrigerant in heat exchanger 10 is directed by the reversing valve 12 to the receiver 18, as has been previously described.

Figure 3:
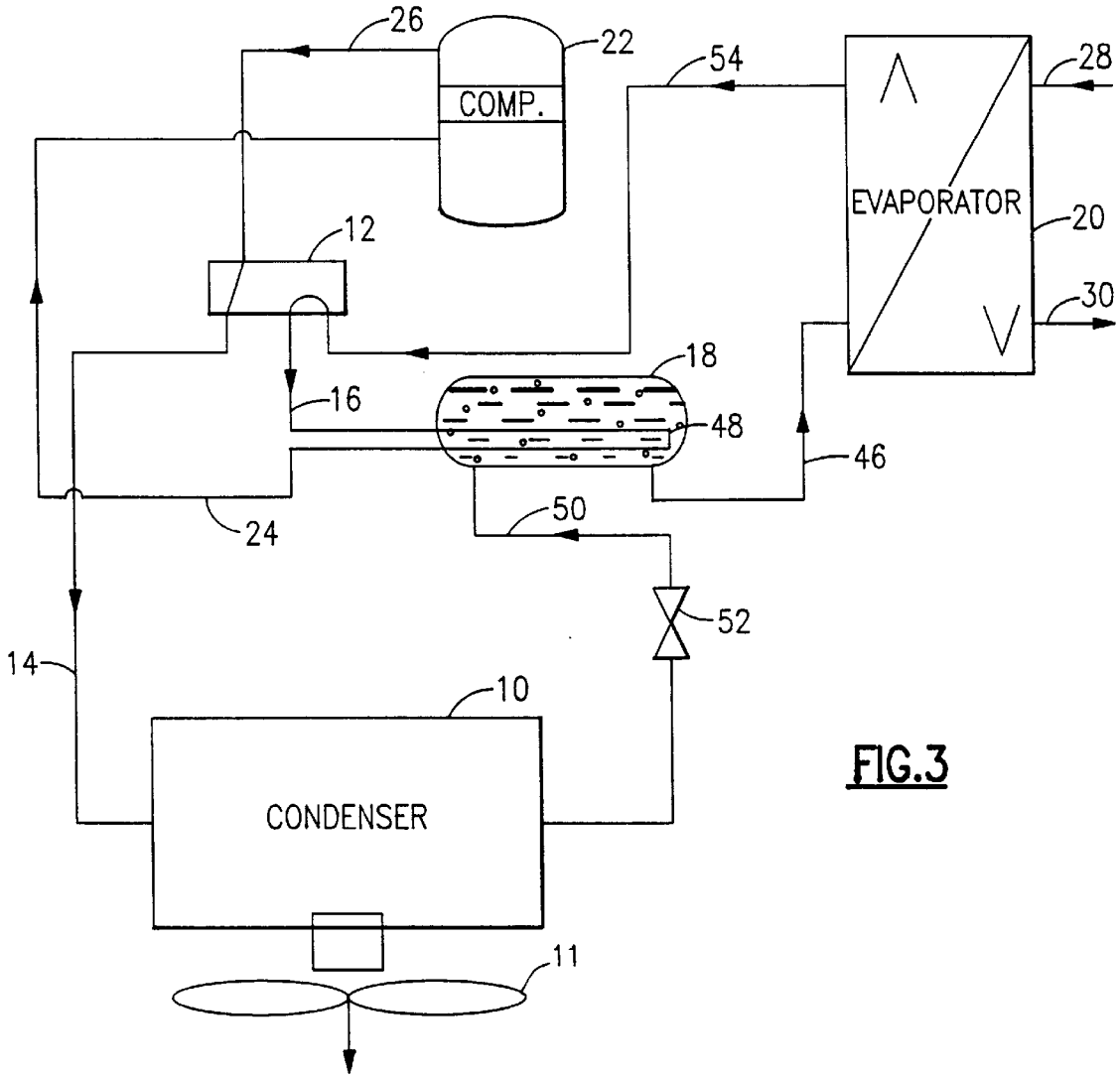
FIG. 3 illustrates the reversible heat pump system of FIG. 1 operating in a cooling mode.

Referring now to FIG. 3, the heat pump system is illustrated in a cooling mode of operation. In the cooling mode, the four way reversing valve 12 directs hot refrigerant vapor discharged by the compressor 22 to heat exchanger 10 operating as a condenser. The heat of condensation is removed from the hot refrigerant vapor by air flowing over the heat exchanger 10. It is to be appreciated that the heat exchanger 10 operating as a condenser in the cooling mode has sufficient refrigerant capacity to handle the subcooled liquid refrigerant at the outlet end. The high pressure subcooled liquid refrigerant leaves the heat exchanger 10 and flows through the thermal expansion valve 52. The liquid refrigerant is discharged from the thermal expansion valve 52 at lower pressure . The refrigerant in two phases thereafter passes through the receiver 18 to the heat exchanger 20 operating as an evaporator in this instance. Since the heat exchanger 20 is preferably a brazed plate heat exchanger, heat will be extracted from water flowing through the channels 44 and 44' and absorbed by the refrigerant flowing through the channels 42 and 42' . The low pressure refrigerant vapor is discharged from the brazed plate heat exchanger 20 into the suction line 54 and is directed by the four way reversing valve 12 to the receiver 18 before being directed to the suction inlet of the compressor 22 via line 24.

It is to be appreciated that the heat pump configuration of FIG. 2 does not require that the receiver 18 operate as a holding device for refrigerant during the cooling mode. On the other hand, there is a considerable amount of refrigerant that needs to be held in the receiver during the heating mode. The receiver 18 must therefore be appropriately sized to accommodate this excess amount of refrigerant in the heating modes of operation. This is preferably accomplished by removing the receiver 18 from the system of FIGS. 1 and 3 and charging the resulting system with different amounts of refrigerant and noting the amount of subcooling of the refrigerant upstream of the thermal expansion valve 52 during the heating and cooling modes of operation. Particular temperature conditions are chosen for the system depending on the environment in which the system is designed to operate in these modes. In particular, ambient temperatures for the outdoor air flowing over the heat exchanger 10 in the heating and cooling modes are chosen. In a preferred embodiment, these temperatures were seven degrees Centigrade dry bulb (six degrees wet bulb) for the heating mode and thirty five degrees Centigrade for the cooling mode. Temperatures are also specified for the water in the line 26 at the inlet of the heat exchanger 20. In a preferred embodiment, these temperatures were forty degrees Centigrade for the heating mode and twelve degrees Centigrade for the cooling mode. Finally, temperatures are specified for the water in the line 30 at the outlet of the heat exchanger 20. In a preferred embodiment, these temperatures were forty five degrees Centigrade for heating and seven degrees Centigrade for the cooling mode. Temperature sensors are also mounted to the lines to the expansion valve 50 so as to sense the temperature of the liquid refrigerant immediately upstream of the expansion valve during heating and cooling. The optimum refrigerant charge for the heating mode is preferably the charge producing five to six degrees of subcooling of the refrigerant from the point at which the refrigerant leaves the heat exchanger 20 and the temperature upstream of entering the thermal expansion valve 52. The optimum refrigerant charge for the cooling mode is preferably the charge producing five to six degrees of subcooling of the refrigerant from the point at which the refrigerant leaves the heat exchanger 10 and the temperature upstream of entering the thermal expansion valve 52.

In a particular embodiment, it was found that the amount of refrigerant needed during the heating mode was fifty percent (50%) less than the amount of refrigerant charge needed in cooling mode. This meant that there was a need to store fifty percent of the refrigerant charge needed in the cooling mode as excess refrigerant in the receiver 18 during the heating mode. An additional volume of between one-quarter and one half of the refrigerant charge needed during cooling was further added to the determined fifty percent (50%) as a safety factor. This resulted in the volume of the receiver being between seventy-five percent (75%) and one hundred percent (100%) of the volume of refrigerant charge needed during cooling. It is to be appreciated that the receiver could be sized even larger so as to provide farther space in the receiver above the liquid refrigerant. There is however a need to make sure that whatever sizing is determined, it must also result in the piping 48 being immersed in the liquid refrigerant so as to provide the necessary subcooling of the liquid refrigerant during normal operating conditions in the heating mode.

Figure 4:
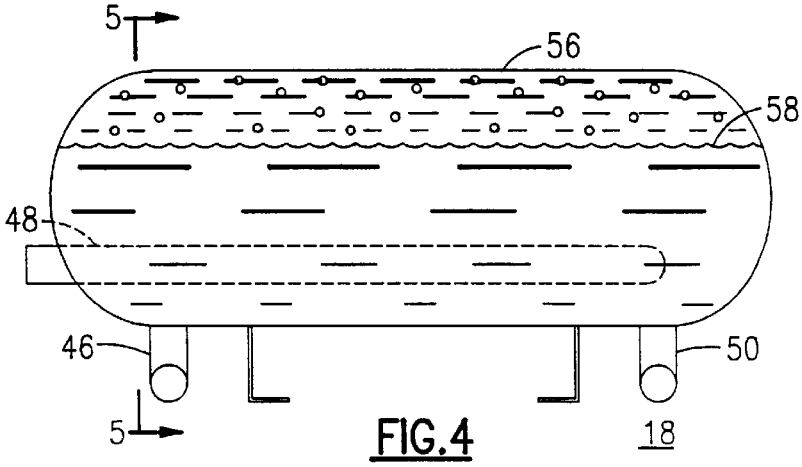
FIG. 4 illustrates a refrigerant receiver used in the heat pump system of FIG. 1.
Figure 5:
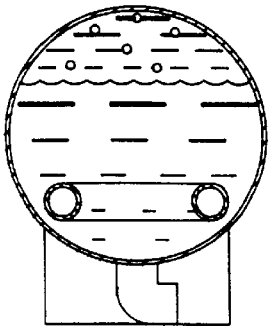
FIG. 5 is a cross-sectional view of the refrigerant receiver of FIG. 3.

Referring to FIGS. 4 and 5, the receiver 18 is illustrated in further detail. The receiver is depicted in the heating mode wherein a significant amount of refrigerant is in a liquid state within the receiver. The receiver is preferably a steel symmetrical tank 56 having a thickness capable of adequately handling the high pressure refrigerant.

The liquid refrigerant within the tank 56 preferably occupies two-thirds of the volume of the tank. This places the liquid level 58 of the refrigerant substantially above the lower half of the tank 56. Refrigerant normally enters the tank 56 via the line 46 from the heat exchanger 20 during the heating mode.

The liquid refrigerant is subcooled by low pressure suction line refrigerant. This suction line refrigerant travels through piping 48 preferably located in the bottom half of the tank 56. The piping must be fabricated from a material and have a wall thickness capable of withstanding the pressure experienced by the piping within the tank. This pressure is the difference between the high pressure liquid refrigerant in the tank 56 and the low pressure refrigerant circulating within the piping during the heating mode. It is also to be appreciated that this thickness should not be significantly more than is necessary to withstand the aforementioned pressures. In this regard, the thickness of the piping must also provide adequate heat conductivity through the wall of the piping so as to efficiently remove heat from the high pressure refrigerant. In a preferred embodiment, the piping 48 is of the same diameter as the suction line piping at the discharge outlet of the heat exchanger 10. The piping 48 is also preferably fabricated from steel. Finally, the length of the piping 48 having a determined diameter, thickness, and chosen material is to be calculated. This is done by calculating the length of piping needed to extract the amount of heat to be withdrawn from the liquid refrigerant in the tank during heating mode in order to obtain a liquid refrigerant subcooling of five or six degrees centigrade at normal heating conditions.

The subcooled liquid refrigerant exits the tank 56 via a line 50. The subcooled refrigerant in the line 50 reaches the thermal expansion valve 52 free of any significant bubbling that might otherwise impact performance of the thermal expansion valve.

From the foregoing description, it can be seen that the present invention comprises a reversible heat pump system including a receiver for receiving refrigerant from a relatively small capacity heat exchanger operating as a condenser in the heating mode of operation. The relatively small heat exchanger is a brazed plate heat exchanger in the particularly described embodiment of the invention. The receiver ensures that this relatively small capacity heat exchanger will not perform any subcooling of the refrigerant in the heating mode. This assures that the internal volume of the brazed plate heat exchanger, which is very small, can transfer refrigerant charge without flooding occurring in the heat exchanger. Since the refrigerant thus leaving the brazed plate heat exchanger is not totally liquid, the suction pressure refrigerant traveling through piping within the receiver provides the necessary condensation to the refrigerant in the receiver before it enters the thermal expansion valve. It is to be understood that even though the suction heat exchange to the refrigerant in the piping in the receiver does add suction pressure drop when operating in the heating mode, this is more than made up by the greater efficiency of the brazed plate heat exchanger operating without any flooding condition. It will be appreciated by those skilled in the art that changes could be made to the above described invention without departing from the scope of the invention. Alterations, modifications and improvements thereto by those skilled in the art are intended to be within the scope of the invention. Accordingly, the foregoing description is by way of example only and the invention is to be limited only by the following claims and equivalents thereto.

What is claimed is:

1. A reversible heat pump system having a heating mode and a cooling mode of operation, said reversible heat pump system comprising:

a first heat exchanger having a heat exchange medium associated therewith, said first heat exchanger being operative to condense refrigerant travelling through the heat exchanger so as to give off heat to the heat exchange medium associated therewith during the heating mode and for absorbing heat from the heat exchange medium during the cooling mode;

a second heat exchanger having a heat exchange medium associated therewith, said second heat exchanger being operative to evaporate refrigerant in the heat exchanger so as to absorb heat from the heat exchange medium associated therewith during the heating mode and for being operative to condense refrigerant so as to give off heat to the heat exchange medium associated with the second heat exchanger during the cooling mode;

a compressor having a suction inlet and a discharge outlet;

a refrigerant holding device for receiving condensed refrigerant from the first heat exchanger during the heating mode;

a thermal expansion valve connected to said refrigerant holding device so as to allow refrigerant held in the refrigerant holding device to thermally expand before entering to the second heat exchanger during the heating mode;

a heat exchange device located in said refrigerant holding device, wherein the refrigerant holding device is a tank, said tank being sized to contain liquid refrigerant received from the first heat exchanger during the heating mode so that the level of liquid refrigerant is above the heat exchange device located in the tank; and a reversible valve operatively connecting the compressor discharge outlet to the first heat exchanger during the heating mode and furthermore connecting the outlet of the second heat exchanger to the inlet of the heat exchanger device located in said refrigerant holding device during the heating mode.

2. The heat pump system of claim 1 wherein said reversible valve operatively connects the compressor discharge outlet to the second heat exchanger in the cooling mode and furthermore connects the outlet of the first heat exchanger to the inlet of the heat exchange device located in said refrigerant holding device during the cooling mode.

3. The reversible heat pump system of claim 2 wherein the heat exchange device located in said refrigerant holding device has an inlet end for receiving refrigerant from said reversing valve and an outlet end for delivering refrigerant to the suction pressure inlet of said compressor.

4. The heat pump system of claim 1 wherein the piping of the heat exchange device located in said refrigerant holding device has a length which results in no more than a three percent (3%) loss of total system heating capacity.

5. The heat pump system of claim 4 wherein the piping of the heat exchange device located in said refrigerant holding device is steel piping.

6. The heat pump system of claim 4 wherein the piping of the heat exchange device located in said refrigerant holding device has a length which results in the liquid refrigerant in said refrigerant holding device being subcooled between five and six degrees Centigrade when the heat pump is operating in a heating mode.

7. The heat pump system of claim 1 wherein the heat exchange device located in said refrigerant holding device subcools the liquid refrigerant in said refrigerant holding device between five and six degrees Centigrade when the heat pump is operating in a heating mode.

8. The heat pump system of claim 1 wherein the sec eat exchanger has a refrigerant capacity greater than the refrigerant capacity of the first heat exchanger.

9. The heat pump system of claim 8 wherein the first heat exchanger is a brazed plate heat exchanger.

10. The heat pump system of claim 9 wherein the heat exchange medium associated with the first heat exchanger is water.

11. The heat pump system of claim 10 wherein the heat exchange medium associated with the second heat exchanger is air.

12. The heat pump system of claim 1 wherein the first heat exchanger is a brazed plate heat exchanger.

13. The heat pump system of claim 12 wherein the second heat exchanger has a refrigerant capacity greater than the refrigerant capacity of the first heat exchanger.

* * * * *